US006149408A

United States Patent [19]

Holt

[11] Patent Number: 6,149,408

[45] Date of Patent: Nov. 21, 2000

[54] COALESCING DEVICE AND METHOD FOR REMOVING PARTICLES FROM A ROTARY GAS COMPRESSOR

[75] Inventor: James A. Holt, Edmond, Okla.

[73] Assignee: Compressor Systems, Inc., Midland, Tex.

[21] Appl. No.: 09/244,809

[22] Filed: Feb. 5, 1999

[51] Int. Cl.[7] ..... F01C 21/04

[52] U.S. Cl. ..... 418/1; 418/85; 418/89; 418/97; 418/98; 417/228; 55/488; 55/521

[58] Field of Search ..... 417/313, 228; 418/1, 85, 89, 97, 98, DIG. 1; 184/6.16; 55/488, 521

[56] References Cited

U.S. PATENT DOCUMENTS

| | | | |
|---|---|---|---|
| 3,056,247 | 10/1962 | Pindzola et al. | 55/488 |
| 4,617,030 | 10/1986 | Heath | 55/20 |
| 5,028,220 | 7/1991 | Holdsworth | 418/97 |
| 5,087,178 | 2/1992 | Wells | 418/DIG. 1 |
| 5,199,858 | 4/1993 | Tsuboi et al. | 418/98 |
| 5,405,253 | 4/1995 | McLaren . | |
| 5,439,358 | 8/1995 | Weinbrecht . | |
| 5,490,771 | 2/1996 | Wehbert et al. . | |
| 5,564,910 | 10/1996 | Huh . | |

FOREIGN PATENT DOCUMENTS

| | | | |
|---|---|---|---|
| 1512507 | 6/1978 | United Kingdom | 418/DIG. 1 |

*Primary Examiner*—Timothy S. Thorpe
*Assistant Examiner*—Cheryl J. Tyler
*Attorney, Agent, or Firm*—Wendy Buskop; Buskop Law Group

[57] ABSTRACT

A compressor system for creating essentially liquid-free fluid flows includes a screw compressor that has an inlet port for receiving a low pressure gas stream, a main lubrication injection port for receiving an injection branch of a filtered lubrication stream, an inlet bearing lubrication port for receiving an inlet branch of the filtered lubrication stream, a discharge bearing and seal lubrication port for receiving a discharge branch of the filtered lubrication stream, a prime mover for powering the rotary screw compressor and a discharge port for discharging a high pressure compressed gas mixture stream from the compressor. The system further includes a separator for receiving the compressed gas mixture stream from the compressor. The separator has at least a primary and a secondary coalescer devices connected in series, such that the primary coalescer device has a smaller surface area than the secondary coalescer device. Additionally, the first coalescer device causes very small liquid particles to become larger liquid particles by flowing the liquid particles through the primary coalescer at a rate which entrains the particles and then flows the entrained liquid particles through the secondary coalescer.

10 Claims, 2 Drawing Sheets

2
4
6
8
10
12
13
14
16
18
20
22
24
25
26
28
30
32
34
36
38
40
42
44
46
48
50
52
54
56
58
60
62
64
66
68
70
78
82
84
86
88
90
92
T
P
PD
V
CP

COALESCING DEVICE AND METHOD FOR REMOVING PARTICLES FROM A ROTARY GAS COMPRESSOR

SPECIFICATION

The present invention relates to the use of a rotary compressor system, an oil separator for use with a rotary compressor system and a method for separating oil in a rotary compressor system which is reusable, continuously operable, and utilizes a series of coalescing devices to eliminate liquid particles from a gas stream utilizing a rotary screw compressor.

BACKGROUND OF THE INVENTION

The present invention generally relates to compressor systems and, more particularly, to oil flooded, rotary screw gas compressor systems having lube-oil circulation systems and apparatus. The present invention relates to a method for enhancing the production from those systems by utilizing a reliable, non-disposable coalescing system to enlarge and entrain liquid particles in a multi-step process yielding a cleaner, liquid free stream than currently available methods.

Helical lobe rotary compressors, or "screw compressors," are well-known in the air compressor refrigeration and natural gas processing industries. This type of gas compressor generally includes two cylindrical rotors mounted on separate shafts inside a hollow, double-barreled casing. The side walls of the compressor casing typically form two parallel, overlapping cylinders which house the rotors side-by-side, with their shafts parallel to the ground. As the name implies, screw compressor rotors have helically extending lobes and grooves on their outer surfaces. During operation, the lobes on one rotor mesh with the corresponding grooves on the other rotor to form a series of chevron-shaped gaps between the rotors. These gaps form a continuous compression chamber that communicates with the compressor inlet opening, or "port," at one end of the casing and continuously reduces in volume as the rotors turn and compress the gas toward a discharge port at the opposite end of the casing. The compressor inlet is sometimes also referred to as the "suction" or "low pressure side" while the discharge is referred to as the "outlet" or "high pressure side."

Screw compressor rotors intermesh with one another and rotate in opposite directions in synchronization within a housing. The impellers operate to sweep a gas through the housing from an intake manifold at one end of the housing to an output manifold at the other end of the housing. Commercially available compressors most commonly include impellers or rotors having four lobes, however, others have been designed to have five or more lobes, however, it may be possible to use a rotor or impeller which has only 2–5 lobes. The present invention relates to a system used in conjunction with this type of rotors.

The rotor shafts are typically supported at the end walls of the casing by lubricated bearings and/or seals that receive a constant supply of lubricant from a lubricant circulation system. Since the lubricant is typically some type of oil-based liquid compound, this part of the compressor system is often referred to simply as the "lube-oil" system. However, the terms "lubricant," "lube-oil," and "oil" encompass a wide variety of other compounds that may contain other materials besides oil, such as water, refrigerant, corrosion inhibitor, silicon, Teflon®, and others. In fact, the name "lube-oil" helps to distinguish this part of the compressor system from other components that may use similar types of oil-based fluids for other purposes, such as for power transmission in the hydraulic system or insulation in the electrical system.

Like the lube-oil circulation system in many automobiles, compressor lube-oil systems generally include a collection reservoir, motor-driven pump, filter, and pressure and/or temperature sensors. Since many lubricants degrade at high temperature by losing "viscosity," lube-oil systems for high temperature applications, such as screw compressors, generally also include a cooler for reducing the temperature of the lubricant before it is recirculated to the seals and bearings. So-called "oil flooded" rotary screw compressors further include means for recirculating lubricant through the inside of the compressor casing. Such "lube-oil injection" directly into the gas stream has been found to help cool and lubricate the rotors, block gas leakage paths between or around the rotors, inhibit corrosion, and minimize the level of noise produced by screw compressors.

A typical oil flooded screw compressor discharges a high-pressure and high-temperature stream consisting of a mixture of gas and oil. The oil and any related liquid must be separated from the high pressure gas. The present invention relates to a technique for coalescing the liquid and oil particles by multi-step process, wherein the first step entrains the particles using a first vane pack and a flow at high velocity, and then a second step passes the particles and gas through a second vane pack, thereby removing essentially all of the liquid and oil particles, creating an essentially liquid and oil free gas stream.

At least two, but optionally, a plurality of vane packs can be used in sequence in the present invention to achieve the desired clean stream effect. The vane packs, which are the coalescing means or "coalescer means", are connected to each other in series and connected based on a defined size relation. In particular, the first vane pack is smaller in surface area than the second vane pack. After leaving the vane packs, which are also called chevron shaped mist eliminators, the gas stream is cooled, filtered, and recirculated to the compressor bearings and main oil injection port.

There are a variety of patents which generally relate to screw compressors and compressors in general, such as U.S. Pat. Nos. 5,439,358, 2,489,997 and 3,351,227 but none discloses the multi-pack filtering concept using vane packs as described in the present invention. Related patents which discuss compressor features, but not the multi-vane pack system of the invention include U.S. Pat. Nos. 5,564,910, 5,490,771, 5,405,253, 4,758,138, 5,374,172, 4,553,906, 5,090,879, 4,708,598, and 5,503,540.

SUMMARY OF THE INVENTION

The screw compressor has a first inlet port for receiving a low pressure gas stream, a main lubrication injection port for receiving a first lubrication stream, an inlet bearing lubrication port for receiving a second lubrication stream, a discharge bearing and seal lubrication port for receiving a third lubrication stream, a prime mover for powering screw compressor and a discharge port for discharging a high pressure compressed gas mixture from the compressor. The compressor system may also include a suction scrubber for removing liquids from the gas before it is supplied to the compressor.

A separator receives the compressed gas mixture and coalesces the liquid particles in at least a two step process, wherein the compressed mixture is passed through at least two coalescing means connected in series to remove liquid particles, and wherein the first coalescing means is smaller in surface area than the second coalescing means. The separator then discharges a high pressure stream (preferably having a viscosity consistent with manufacturer's specifications for the operation of the rotary screw compressor) and a high pressure gas stream. In one embodiment, the high pressure lubricant stream preferably has a viscosity of at least 4 centistokes.

A splitter divides the high pressure lubrication stream into a first flow or branch and a second flow or branch. The first flow is received by a cooler for creating a cooled first flow while the second flow is received and mixed with the cooled first flow by a thermostat to create a mixed flow. A filter assembly receives and filters the mixed flow and creates a filtered flow. The filter assembly may include at least one liquid filter and/or an gas pressure gauge and an outlet pressure gauge for enabling monitoring of the pressure of the mixed flow into the filter assembly and the filtered flow out of the filter assembly.

FIGURES

The above and other objects, features and other advantages of the present invention will be more clearly understood from the following detailed description taken in conjunction with the accompanying drawings, in which.

DETAILED DESCRIPTION

Figure 1:
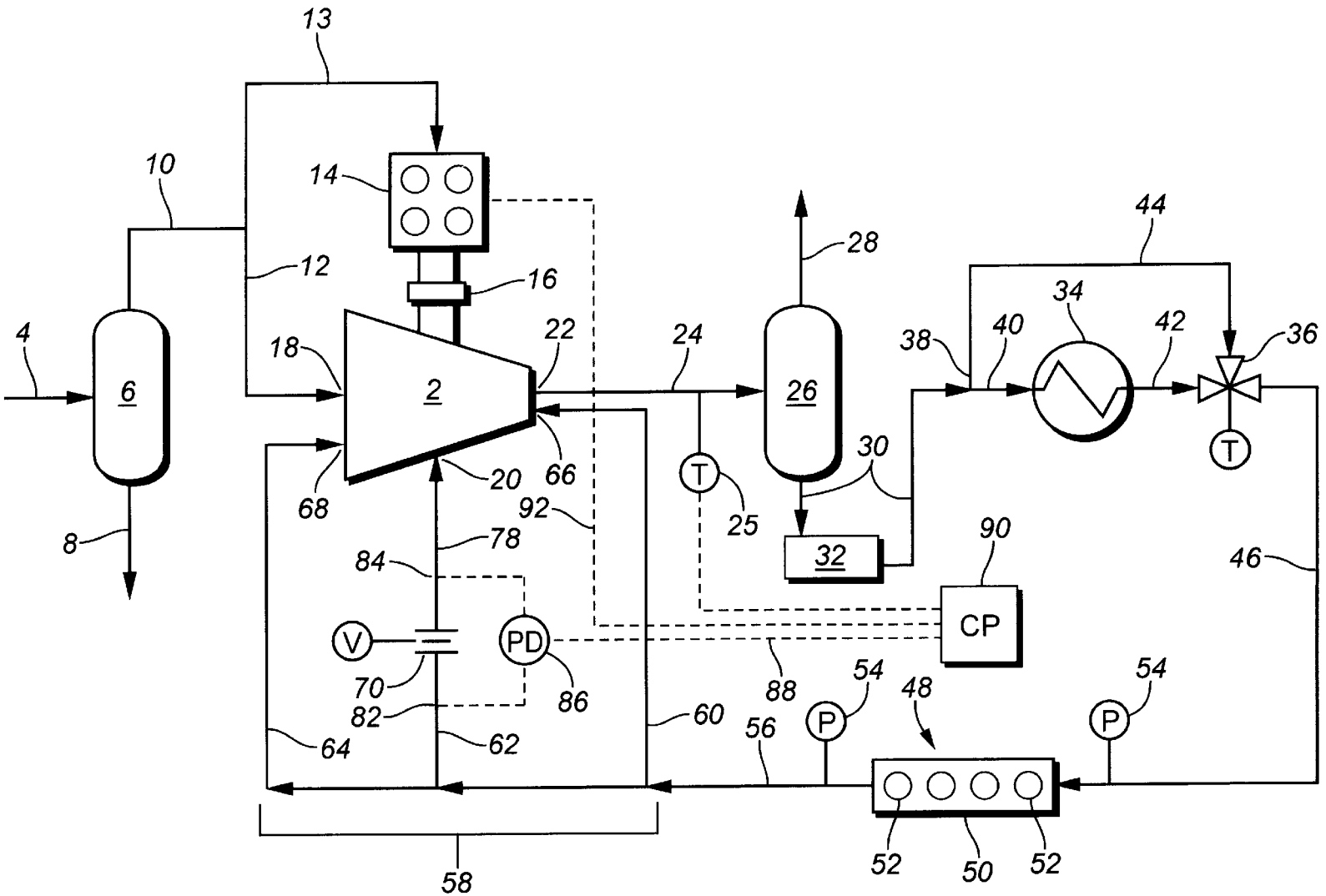
FIG. 1 is a diagram of the compressor system utilizing the novel coalescing means of the present invention.

FIG. 1 shows a diagram of a gas compression process and compressor system including a rotary screw gas compressor 2. The compressor 2 is preferably a Model TDSH (163 through 355) rotary screw compressor available from Frick Company in Waynesboro, Pa. However, a variety of other oil flooded rotary screw compressors may also be used.

In FIG. 1, a raw gas feed stream 4 from a natural gas well (not shown), or other gaseous fluid source, is supplied to a scrubber 6 for separating fluids and any entrained solids from the raw gas stream 4. The scrubber 6 may be any suitable two- or three-phase separator which discharges a liquid stream 8 to a disposal reservoir (not shown) and an essentially dry low pressure gas stream 10 to the compressor 2. The gas may also be dried using other well-known conventional processes. The dry low pressure gas stream 10 is then supplied to an gas stream 12 and may also be supplied to a fuel stream 13 for fueling a prime mover 14. Although the prime mover 14 shown in FIG. 1 is a natural gas engine, a variety of other power plants, such as diesel engines or electric motors, may also be used to drive the compressor 2 through a coupling 16.

The compressor 2 receives low pressure gas through an inlet port 18. A suitable lubricant, is supplied to the inside of the casing of the compressor 2 through a main oil injection port 20 where it is mixed with the gas to form a low pressure gas/oil mixture. The low pressure gas/oil mixture is then compressed and discharged from the compressor 2 through a discharge port 22 into a high pressure gas/oil mixture stream 24. The discharge temperature of the gas/oil mixture from compressor 2 may be monitored by a temperature sensor 25.

Figure 2:
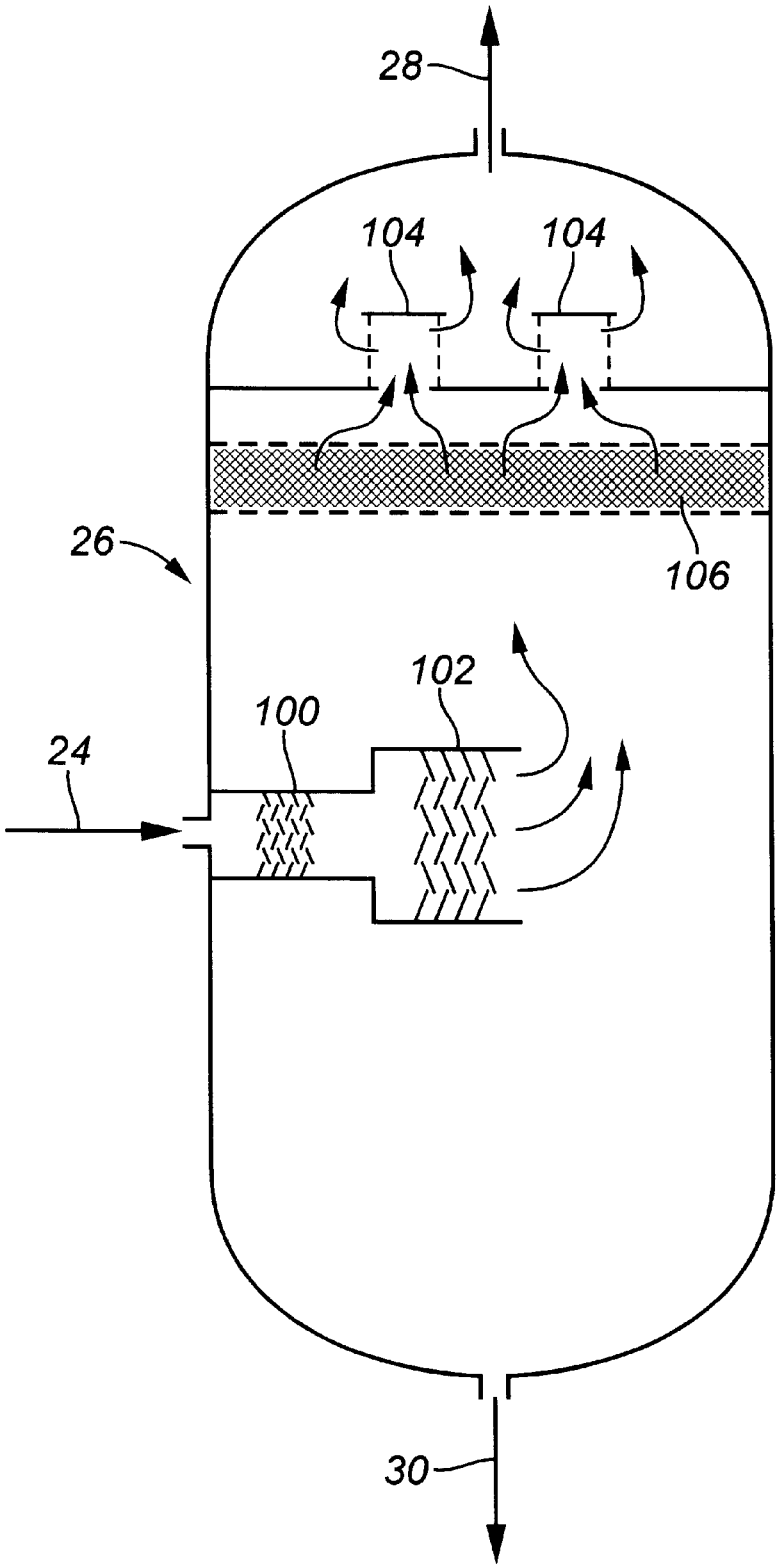
FIG. 2 is a diagram of the separator 26 with the unique coalescing means of the present invention.

FIG. 2 shows in detail the separator 26 which receives the high pressure gas/oil mixture stream 24 and first coalesces the liquid particles in a first coalescing means 100, which is also conventionally known in the business as a "vane pack." This is the first of at least two vane packs which can be used in series to coalesce liquid in this system. The high pressure gas/oil mixture stream 24 is passed through a first vane pack 100, at a velocity so that the liquid particles are entrained along the sides of the first vane pack 100, causing the particles to enlarge from a size of up to about 1 micron to a size of about 25 microns, or even larger such as over 35 microns. The entrained particles are then passed in the high pressure gas/oil mixture to a second coalescing means, which is another vane pack, hereafter termed "the second vane pack" 102. The second vane pack, 102, has a surface area which is larger than the first vane pack 100. In a preferred embodiment, it is expected that the second vane pack would be at least 50% larger in surface area than the first vane pack. In the most preferred embodiment, the second vane pack 102 would be 4 times the surface area of the first vane pack 100.

The treated high pressure gas/oil mixture can be optionally passed through additional coalescing vane packs. Probably no more than 10 additional vane packs would be used in any one compressor to clean the stream of particles. However, there could be no limit, other than commercial practicality to the number of vane packs used to remove liquid particles and create an essentially liquid free gas phase. An essentially liquid free gas phase would typically maintain a liquid content in the gas stream at less than approximately 25 ppm. The additional coalescing means are shown as 104, the number 104 is intended to represent one or more of these coalescing means which can be porous filters.

As an alternative embodiment, inside the separator, a second mesh pad 106 can be used. Also it should be noted that a mesh pad can be used instead of the second vane pack. In another embodiment, a mesh pad could be used as a third or fourth vane pack, after using two vane packs identical to vane pack 100. The mesh pad is preferably a knitted wire mesh pad. The wire of the mesh pad can be made out of different materials, and can be, for example, steel wool. Optionally, the vane packs can be co-knit fibers which are impervious or highly resistant to the corrosiveness of the natural gas stream high pressures and high temperatures. Usable vane packs of the present invention can include fiber bed vane packs. The knitted wire mesh pads and parallel vane units are the most common methods of removing entrained liquid droplets from gas streams in industrial processes. These are known as mist eliminators or sometimes "chevron mist" eliminators. The mesh pad is designed for a certain kind of thickness for the mesh, such as a 6 or 8 inch thick pad, however, other styles, and windings may be used.

The vane packs normally come in 8 inch thick pads, but are also available in other sizes, such as 6 inch sizes or smaller or even larger. There are several different types of vane packs. Vane packs can have hooks to trap liquids, they can have different angles for flowing the gas stream. Some vane packs are known as chevron shaped mist eliminators. Vane packs usable in the present invention can be purchased from ACS Industries, LP of 14211 Industry Road, Houston, Tex. 77053 and the most usable ones sold by this company are known as "Plate-Pak" units, with the term "Plate-Pak" being a trademark of ACS Industries. One, two, three, four or more vane packs can be used in series and be within the scope of the contemplated invention.

The vessel diameter of the separator 26, has to be carefully selected, so that the liquid particles which have been coalesced and formed in the vane packs can drip off of the vane packs, unimpeded by the upward high pressure gas flow rate, and then fall to the bottom of the separator vessel 26.

Returning to FIG. 1, the separator 26 discharges a high pressure gas stream 28 for further processing and/or distribution to customers. In addition, the separator also discharges a high temperature oil stream 30 to a lube-oil cooler 34, which can be, in some cases, a lube-oil collection reservoir 32 via one- to three-inch diameter stainless steel tubing, or other suitable conduits. Alternatively, the lube-oil may simply collect at the bottom of the separator 26. The lube-oil cooler 34 preferably cools the high temperature lube-oil stream 30 from a temperature in the range of 190° F. to 220° F., or preferably 195° F. to 215° F., to a temperature in the range of 120° F. to 200° F., and preferably in the range of 140° F. to 180° F., or nearly 170° F. for an oil flow rate of about 10–175 gallons per minute.

Typical coolers that may be used with the disclosed compressor system include shell and tube coolers such as ITT Standard Model No. SX 2000 and distributor Thermal Engineering Company's (of Tulsa, Okla.) Model Nos. 05060, 05072, and others. Plate and frame coolers, such as Alfa Laval MGFG Models (with 24 plates) and M10MFG Models (with 24 or 38 plates) may also be used, as may forced air "fin-fan" coolers such as Model LI56S available from Cooler Service Co., Inc. of Tulsa, Okla. A variety of other heat exchangers and other cooling means are also suitable for use with the compressor system shown.

In a preferred embodiment, the temperature of the lubricant leaving the lube-oil cooler 34 is controlled using a by-pass stream 44 and a thermostat 36 which is preferably a three-way thermostatic valve such as Model No. 2010 available from Fluid Power Engineering Inc. of Waukesha, Wisc. Although the manufacturer's specifications for this particular type of valve show it as having one inlet port and two outlet ports, it may nonetheless be used with the present system by using one of the valve's outlet ports as an inlet port. Other lube-oil temperature control systems besides thermostats and/or thermostatic control valve arrangements may also be used.

In the present invention, the oil pressure to the bearings must be maintained at a suitably high pressure, preferably higher than the pressure of the gas supply to the compressor in order to prevent the gas from invading the bearings. To provide a margin of safety, oil from the bearings is allowed to drain to position inside the casing near a pressurized "closed thread" on the rotors. A closed thread is a position on the rotors which is isolated from both the suction and discharge lines, and therefore contains gas at a pressure between the suction and discharge pressures. The closed thread is preferably at a position along the length of the rotors where the pressure is about one and a half times the absolute suction pressure of the compressor at full capacity. Consequently, the pressure of the oil leaving the bearings is maintained at roughly one and a half times the absolute pressure of the compressor inlet.

As shown in FIG. 1, the high temperature oil stream 30 is split into two branches (or "flows") by a two-way splitter 38 prior to reaching the thermostat 36. The splitter 38 is preferably formed from T-shaped stainless steel tubing; however, other "T" fittings may also be used. The first branch 40 of high temperature lube-oil stream 30 goes directly into the cooler 34 where it is discharged through a cooled lube-oil branch 42 into the thermostatic valve 36 which has two inlets and one outlet. The second, or "by-pass," branch of high temperature lube-oil stream 30 bypasses the cooler 34 and goes directly into the thermostatic valve 36 where it may be mixed with lubricant from the cooled lube-oil branch 42 to control the temperature of a mixed (first and second branch) cooled lube-oil stream 46 leaving the thermostatic valve 36. By controlling the amount of lube-oil from each of the first and second branches or "flows" 42 and 44 flowing through the thermostatic valve 36, the thermostatic valve 36 can control the temperature of the cooled lube-oil stream 46 leaving the thermostatic valve 36.

The cooled lube-oil stream 46 then flows through a filter assembly 48 to create a filtered stream 56. The filter assembly 48 includes a housing 50 for supporting a plurality of filters 52. A preferred filter housing 50 is available from Beeline of Odessa, Tex., for supporting four filters 52, such as Model Nos. B99, B99 MPG, and B99HPG available from Baldwin Filters of Kearney, Nebr. However, a variety of other filters and filter housings may also be used. Pressure indicating sensors 54 may also be provided at the inlet and outlet of the filter housing 50 for determining the pressure drop across the filters 52 and providing an indication as to when the filters need to be changed. The filter assembly 48 may also be arranged in other parts of the process, such as between the reservoir 32 and two-way splitter 38.

Optionally, the present invention may include a mechanism whereby downstream of the filter assembly 48, the filtered lubricant stream 56 flows into a three-way splitter 58 forming a discharge bearing and seal branch 60, an orifice branch 62, and a suction bearing branch 64. The discharge bearing branch 60 provides filtered and cooled lube-oil to the seals and discharge bearings of the compressor 2 through a lubrication port 66 while the inlet bearing branch 64 provides filtered and cooled lube-oil to the inlet bearings, and possibly a balance piston, through lubrication port 68.

The present invention relates to the use of a plurality of vane packs, at least two, which are termed coalescing means in this patent. A first vane pack is preferably used at a flow through rate beyond the stated limitations of the vane pack, which then would cause particles to grow in size yet stay in the gas phase. The first vane pack effectively causes the particles to be entrained and grow larger, while passing at a high velocity while still in the gas phase to a second vane pack. One of the novel features of the present invention relates to the size of the vane packs. In the most preferred embodiment, the size of the first vane pack is smaller in surface area than the second vane pack in a ratio of 4:1, and the two vane packs are connected in series.

The second vane pack would preferably operate at or less than the stated vane pack limits. In the preferred embodiment, not only would the second vane pack be larger in surface area than the first vane pack but it also should be capable of effectively coalescing all the particles from the first vane pack into particle sizes large enough for gravity to effect separation of the particles from the gas phase. This multiple vane pack configuration enables a wide range of particles to become entrained in the second vane pack and then possibly eliminate the need for disposable coalescing filters.

It is particularly notable that a separator with more than one vane pack, as suggested in the present invention, will now operates at very low velocities as well as high velocities, effectively broadening the range of the separator and the overall compressor system.

In an alternative embodiment, it is possible to have the vane packs in a configuration in the separator where the small vane pack is after the larger vane pack. While the advantages of the entrainment of the particle would be lost, the two pack system would still yield the increased capacity, and range of the separator.

It is also important to note that at low velocities of gas flow through, that the combination of the two vane packs work much better and more effectively than one vane pack, increasing the range of the compressor.

It is believed that the compressor of the present invention will find utility in a wide variety of applications, particularly where sustained pumping operation is desired. These improved compressors may be usable in the natural gas and oil business, and also for water pumping systems, food processing systems, and possibly freeze drying systems which utilize compressors.

The above described description and the drawing shown are only an example of what is contemplated to be within the scope of the invention. It is to be understood that the invention is not limited to the precise embodiments described above and that various changes and modifications may be effected therein by one skilled in the art without departing from the spirit of the invention as defined.

What is claimed is:

1. A compressor system for use with fluid flows to create essentially liquid-free flows, comprising, a rotary screw compressor having:

(i) an inlet port for receiving a low pressure gas stream, (ii) a main lubrication injection port for receiving a first lubrication stream, (iii) an inlet bearing lubrication port for receiving a second lubrication stream, (iv) a discharge bearing and seal lubrication port for receiving a third lubrication stream, (v) a prime mover for powering the rotary screw compressor, and (vi) a discharge port for discharging a high pressure compressed gas mixture from the compressor;

a separator for receiving the compressed gas mixture from the compressor, wherein the separator further consists of at least a primary coalescer means and a secondary coalescer means connected in series, wherein the primary coalescer means is smaller in surface area than the secondary coalescer means, and wherein the primary coalescer means causes very small liquid particles to become larger liquid particles when passed through the primary coalescer means at a rate which entrains the liquid particles, and then flowing the entrained liquid particles through the secondary coalescer means at a rate which forms a resulting gas; then separating the resulting gas from the entrained liquid particles, and discharging the separated gas as a high pressure gas stream and a high pressure lubrication stream;

a first splitter for dividing the high pressure lubrication stream into a first flow and a second flow;

a cooler for receiving the first flow of the high pressure lubrication stream and cooling the first flow into a cooled flow;

a thermostatic device for receiving and mixing the cooled flow and the second flow creating a mixed flow; and a filter for filtering the mixed flow creating a filtered flow.

2. The compressor system of claim 1, wherein the primary coalescer means and the secondary coalescer means are vane packs.

3. The compressor system of claim 1, wherein the primary coalescer means and secondary coalescer means are wire mesh units.

4. The compressor system of claim 1, wherein the primary coaleser means causes very small liquid particles having a diameter approximately greater than 1 micron to coalesce into droplets which are re-entrained as liquid particles having a diameter of greater than 25 microns.

5. The compressor system of claim 1, wherein the primary coalescer means causes very small liquid particles having a diameter approximately greater than 1 micron to coalesce into drops which are re-entrained as liquid particles having a diameter of greater than 50 microns.

6. The compressor system of claim 1, wherein the compressor system is for use with natural gas.

7. The compressor system of claim 1, further comprising a control panel connected to the rotary screw compressor to remotely control fluid flow rates through the compressor.

8. A compression process for fluids, comprising the steps of:

receiving a low pressure gas stream into a rotary screw compressor;

compressing the low pressure gas stream with said rotary screw compressor thereby creating a compressed gas mixture;

separating the compressed gas mixture by coalescing liquid particles using a primary coalescer means and a secondary coaleser means connected in series, further comprising the steps of passing the compressed gas mixture through the primary coaleser means at a velocity which causes entrainment of liquid particles, and wherein the resulting entrained liquid particles are enlarged from a diameter of greater than 1 micron to a diameter greater than 25 microns creating a first stream and then passing said first stream through the secondary coalescer means at a velocity which forms a resulting stream;

splitting the resulting stream into a first flow and a second flow;

cooling the first flow creating a cooled flow;

mixing the cooled flow with the second flow creating a mixed flow;

filtering the mixed flow creating a filtered flow; and splitting the filtered flow into a least three branches, an injection branch, an inlet branch and a discharge branch thereby creating three essentially liquid-free compressed streams.

9. The process of claim 8, wherein the compression process is for the compression of natural gas.

10. The process of claim 8, further comprising the step of using a tertiary coatescer means to removes additional liquid particles which flow from the secondary coalescer means to form a stream having liquid in the range of less than 25 ppm.

* * * * *